US006418844B1

(12) United States Patent
Franklin et al.

(10) Patent No.: US 6,418,844 B1
(45) Date of Patent: Jul. 16, 2002

(54) INKING UNIT FOR A PRINTING MACHINE

(75) Inventors: Stephen Franklin, Durham, NH (US); Bertold Grützmacher; Wolfgang Schönberger, both of Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/583,786

(22) Filed: May 31, 2000

(30) Foreign Application Priority Data

May 31, 1999 (DE) ..... 199 24 997

(51) Int. Cl.[7] ..... B41L 23/00

(52) U.S. Cl. ..... 101/147; 101/169; 101/350.1; 101/350.6

(58) Field of Search ..... 101/147, 148, 101/350.6, 352, 450.1, 366, 349.1, 340, 351.1, 351.8, 348, 350.1

(56) References Cited

U.S. PATENT DOCUMENTS

| | | | | | |
|---|---|---|---|---|---|
| 2,196,412 | A | * | 4/1940 | Grembecki | 101/147 |
| 2,676,536 | A | * | 4/1954 | Ste-Marie | 101/141 |
| 2,843,040 | A | * | 7/1958 | Childers | 101/141 |
| 4,341,156 | A | * | 7/1982 | Kaeppner | 101/141 |
| 4,418,620 | A | * | 12/1983 | Fischer | 101/350 |
| 4,452,139 | A | * | 6/1984 | Dahlgren et al. | 101/148 |
| 4,524,689 | A | | 6/1985 | Lemaster | |
| 4,753,165 | A | | 6/1988 | Grosshauser | |
| 5,012,737 | A | | 5/1991 | Makino et al. | |
| 5,085,142 | A | * | 2/1992 | Smith | 101/148 |
| 5,165,342 | A | | 11/1992 | Weishew | |
| 5,209,160 | A | * | 5/1993 | Smith | 101/148 |
| 5,454,310 | A | * | 10/1995 | Hayes | 101/148 |
| 6,145,437 | A | * | 11/2000 | Bock et al. | 101/349.1 |

FOREIGN PATENT DOCUMENTS

| | | |
|---|---|---|
| DE | 226 839 | 9/1985 |
| DE | 35 41 458 A1 | 5/1987 |
| DE | 35 41 458 | 5/1987 |
| DE | 37 25 971 | 2/1989 |
| DE | 39 30 822 | 11/1990 |
| DE | 42 25 451 | 2/1993 |
| DE | 689 22 925 | 11/1995 |

OTHER PUBLICATIONS

Japanese Patent Abstract No. 61277450 (Tamiyoshi), dated Dec. 8, 1986.

* cited by examiner

*Primary Examiner*—Eugene Eickholt
(74) *Attorney, Agent, or Firm*—Laurence A. Greenberg; Werner H. Stemer; Gregory L. Mayback

(57) ABSTRACT

An inking unit for a printing machine, having a metering system for printing ink, and equipment for conveying ink on a conveyor path between the metering system and a plate cylinder of a printing machine, includes a vacuum chamber for evaporating a dampening-solution portion from the printing ink.

17 Claims, 8 Drawing Sheets

INKING UNIT FOR A PRINTING MACHINE

BACKGROUND OF THE INVENTION

FIELD OF THE INVENTION

The invention relates to an inking unit for a printing machine and, more particularly, such an inking unit having a metering system for printing ink, and equipment for conveying printing ink on a conveyor path between the metering system and a plate cylinder of a printing machine. An inking unit of this general type is disclosed, for example, in the published German Patent Document DE 3 541 458 A1.

An important problem in the development and the operation of printing machines for offset printing is correct metering of dampening solution. Conventional printing machines use so-called inking units and dampening units to supply ink and dampening solution to a printing plate mounted on a plate cylinder. During a printing operation, unused dampening solution can penetrate into the ink travel path in the inking unit and dilute the printing ink emulsion. Particularly in the case of short inking units, because of the small number of splitting points between rollers and the small roller surface, the dampening solution cannot adequately emerge from the emulsion again. Especially in the case of printing from lightweight plates with little ink removal, but accordingly with a large quantity of dampening solution on the printing plate, the proportion of dampening solution in the emulsion can therefore increase over the course of the operation, which leads to printing problems and, under certain circumstances, to breakdown of the offset process. In order to counter this problem, the published German Patent Document DE 3 541 458 A1 includes a proposal to use a blower which directs an air flow onto a roller in the inking unit, in order to vaporize excessive dampening solution thereat. This leads to considerable air movements within the dampening unit and the printing machine, respectively, which can also have an effect upon the amount of dampening solution on other surfaces than that of the roller to which the flow is directed. These effects can be both additional evaporation at these other surfaces and, at another location, condensation of dampening solution evaporated at the roller to which the flow is directed. The type and extent of these effects can depend upon the changing climatic conditions in a room wherein the printing machine is set up. It is therefore difficult for an operator to control the output of the blower in a targeted manner and without previous testing so that a desired degree of drying of the emulsion is achieved.

Particularly if a heated airflow is used in order to reinforce the drying effect, considerable effects upon regions of the printing machine to which the flow is not directed cannot be avoided. In addition, the energy use in the case of such a procedure is considerable. Last but not least, the draft in the environment of the machine and the noise which is produced by such a blower is disturbing for personnel working at the printing machine.

SUMMARY OF THE INVENTION

It is accordingly an object of the invention, therefore, to provide an inking unit of the type noted in the introduction hereto wherein exactly reproducible control of the degree of drying of a roller is possible with a low expenditure of power and, in addition, any influence of the drying operation upon the climatic conditions on other surfaces of the inking unit, which carry dampening solution, or of a printing machine wherein the inking unit is used, is ruled out.

With the foregoing and other objects in view, there is provided, in accordance with the invention, an inking unit for a printing machine, having a metering system for printing ink, and equipment for conveying ink on a conveyor path between the metering system and a plate cylinder of a printing machine, comprising a vacuum chamber for evaporating a dampening-solution portion from the printing ink.

In accordance with another feature of the invention, the conveyor path passes through the vacuum chamber.

In accordance with a further feature of the invention, the vacuum chamber is bounded on a longitudinal side thereof by at least one roller of the ink-conveying equipment.

In accordance with an added feature of the invention, the vacuum chamber is also bounded by a hood-like cover extending along the roller and having longitudinal edges facing towards the roller.

In accordance with an additional feature of the invention, the longitudinal edges are sealed off by contact-free seals.

In accordance with an alternative feature of the invention, the longitudinal edges are sealed off by closing doctor blades.

In accordance with yet another feature of the invention, the closing doctor blades are engaged with the roller so as to be pressed against the roller by air pressure prevailing in the surroundings of the pressure chamber.

In accordance with yet a further feature of the invention, the roller is a screen roller, and the metering system comprises an inking chamber arranged on the screen roller.

In accordance with yet an added feature of the invention, the vacuum chamber directly adjoins the inking chamber.

In accordance with yet an additional feature of the invention, the vacuum chamber and the inking chamber are separated from one another by a common doctor blade.

In accordance with still another feature of the invention, the ink-conveying equipment includes at least another roller forming with the one roller a chain of mutually contacting rollers, at least the longitudinal side of the vacuum chamber being formed by the train of mutually contacting rollers.

In accordance with still a further feature of the invention, the vacuum chamber has end faces closed by respective plates.

In accordance with still an added feature of the invention, a liquid or plastic sealing material is held between the rollers and the plates by at least one of electrostatic and magnetic interaction.

In accordance with still an additional feature of the invention, the metering system includes a storage container, and the vacuum chamber is connected directly to the storage container.

In accordance with a concomitant feature of the invention, the vacuum chamber is disposed in a line for feeding ink back into a storage container of the metering system or for feeding ink from the storage container to an inking chamber on a roller.

The object of the invention is thus achieved with the aid of a vacuum chamber for evaporating a portion of the dampening solution from the delivered ink. The boiling point of the dampening solution, which is reduced in the vacuum chamber, promotes effective evaporation; dampening-solution vapor can be extracted via a pump used to generate the vacuum.

Although the published German Patent Document 4 225 451 A1 has already disclosed an inking unit for a printing machine having a suction pump connected to the metering system, this is not used to dry ink during running operation but to extract ink from the metering system when the machine is at a standstill, in the event of a color change.

The total quantity of gas to be conveyed is small in comparison with the air throughput of the heretofore known device. Influencing the behavior of the printing machine through vapor extracted from the vacuum chamber is therefore not very probable; this vapor is preferably discharged at a point where it cannot penetrate into the printing machine again, for example outside the room where the printing machine is set up.

The vacuum chamber is preferably arranged in such a way that the conveyor path passes through it. It therefore has the opportunity to influence the level of dampening solution in the ink directly before reaching the plate cylinder, i.e., immediately before the time which is critical for the quality of the print, or directly after contact with the impression cylinder, i.e., at a time whereat the dilution of the ink by dampening solution is relatively high.

According to a first possible construction, the vacuum chamber is bounded on a longitudinal side thereof by at least one roller belonging to the equipment for conveying ink, in other words the roller forms one wall of the vacuum chamber. Another wall of the vacuum chamber can be bounded by a hood-like cover, which extends along the roller and has longitudinal edges facing towards the roller.

In order to maintain a vacuum effectively in the chamber, the longitudinal edges are sealed off in relation to the roller, the type of seal that is selected being based upon the surface of the roller. In principle, the vacuum chamber can be arranged on any desired roller in the inking unit. If the roller has a soft surface which has little resistance to abrasion, use is preferably made of contact-free seals, in particular labyrinth seals, on the longitudinal edges. The same is true if the chamber is fitted to an ink applicator roller having the diameter of the plate cylinder. This is because, during printing, the relief of the subject is automatically formed on such an ink applicator roller, and this must not be destroyed by contact with seals of the vacuum chamber if it is wished to reliably avoid ghosting during printing.

If the surface of the roller adjoining the vacuum chamber is hard and/or a blurring of ink emulsion on the roller by seals of the vacuum chamber is not disruptive or is even possibly desired, in order to distribute the ink as uniformly as possible on the roller, use will expediently be made of contacting seals, for example in the form of a closing doctor blade. This construction is particularly expedient if the roller is a screen roller.

In this case, the closing doctor blades are preferably set against the roller in such a way that they are pressed against the roller by the air pressure prevailing in the surroundings of the chamber.

In this regard, the vacuum chamber can be provided upline or downline, as viewed in the direction of rotation of the screen roller, of an inking chamber likewise arranged on the latter and forming part of the metering system. A particularly space-saving possibility is to arrange the vacuum chamber directly adjacent to the inking chamber. In this case, a common doctor blade, which separates the vacuum chamber and the inking chamber from one another, can be used, on the one hand, to seal off the vacuum chamber with respect to the inking chamber, which is under a slight positive pressure during operation, and, on the other hand, for metering ink discharged from the inking chamber.

According to a second construction, the longitudinal sides of the vacuum chamber can be formed by a train of mutually contacting rollers. Because these rollers rotate together in contact with one another, they pick up ink emulsion from the conveyor path, the ink being distributed over the surface of all the rollers. In this way, virtually the entire inner surface of the chamber is used for vacuum-assisted drying.

The end faces of the chamber are closed off by plates. Gaps between the rollers and the plates are preferably sealed off by a liquid or plastic sealing material, which is kept in place by electrostatic or magnetic interaction.

In further possible constructions, provision is made for the vacuum chamber to be connected directly to the storage container for the printing ink, so that the ink in the container is continuously exposed to the vacuum, or for the vacuum chamber to be arranged in a line for feeding ink back into the storage chamber or for feeding ink to an inking chamber on a roller.

Other features which are considered as characteristic for the invention are set forth in the appended claims.

Although the invention is illustrated and described herein as embodied in an inking unit for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1A:
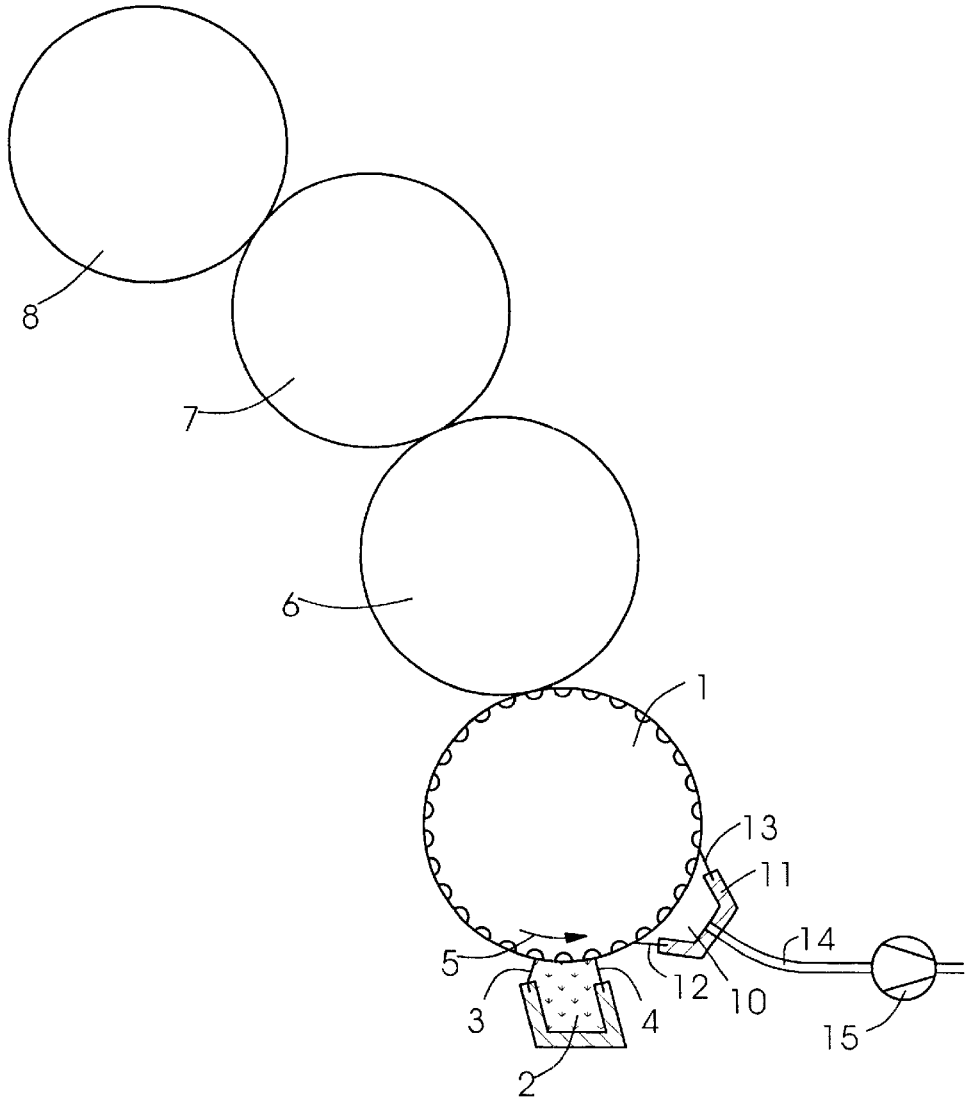
FIG. 1*a* is a fragmentary diagrammatic side elevational view of an inking unit and a printing machine, respectively, partly in section, wherein the invention of the instant application is incorporated.

FIG. 1 shows, in a highly diagrammatic side elevational view, partly in section, parts of a printing machine having an inking unit according to the invention. The inking unit includes a screen roller 1, for example an anilox roller, at the surface of which there is arranged an inking chamber 2 of an ink metering system. The inking chamber 2 extends over the axial length of the screen roller 1 and contains a printing ink that is under positive pressure. Two elastic closing doctor blades 3 and 4 extend along the long edges of the inking chamber 2, and the edges of the doctor blades 3 and 4, respectively, are pressed against the screen roller 1 by the positive pressure prevailing in the chamber 2. The closing doctor blade 4 that is disposed downline, as viewed in the direction of rotation (represented by the arrow 5) of the screen roller 1, meters the ink removed from the chamber 2, by wiping off the surface of the screen roller 1, so that only ink that has penetrated into depressions engraved or otherwise formed in the surface of the screen roller can leave the inking chamber 2.

The ink metered in this manner is conveyed onward by the rotation of the screen roller 1 to a splitting point, at which the screen roller 1 and an ink applicator roller 6 are in engagement. The ink applicator roller 6 accepts part of the ink and conveys it onward to a plate cylinder 7 carrying a non-illustrated printing plate. Printing stock or a material to be printed on runs through a nip between the plate cylinder 7 and a blanket cylinder 8.

Dampening solution, which is applied by a non-illustrated dampening unit to non-printing areas of the printing plate, passes onto the ink applicator roller 6 at the clamping location between the plate cylinder 7 and the ink applicator roller 6 and, together with non-removed ink or ink that has not been picked up, is conveyed back in a direction towards the screen roller 1. In order to avoid dilution by this dampening solution of the ink to too great an extent, and thus impairment of the printing process, a vacuum chamber 10 is provided on the screen roller 1. This vacuum chamber 10 includes an elongated hood 11, which extends along the screen roller 1, over the same length as that of the inking chamber 2, and is all-around sealed off from the latter. The seals disposed in the longitudinal direction of the screen roller 1 include closing doctor blades 12 and 13, as in the inking chamber 2, but with the difference that the doctor blade 12 disposed upline in the direction of rotation is arranged so as to lead, and the downline doctor blade 13 is arranged so as to trail. In the case of the inking chamber 2, the arrangement is reversed. By this arrangement of the doctor blades 12 and 13, they are pressed against the surface of the screen roller 1 by the atmospheric pressure prevailing in the environment of the vacuum chamber 10. Seals at the longitudinal ends of the chamber 10 are not illustrated.

A suction line 14 connects the vacuum chamber 10 to a suction pump 15, and is connected to the vacuum chamber 10 at a location essentially selected based upon the installation conditions of the vacuum chamber 10 in the inking unit. The suction capacity of the pump 15 and, therefore, the pressure prevailing in the vacuum chamber 10, can be set as a function of a desired drying level of the ink conveyed through the chamber. Typical values of the pressure in the vacuum chamber 10 lie within a range of 700 hectopascal or below.

Figure 1B:
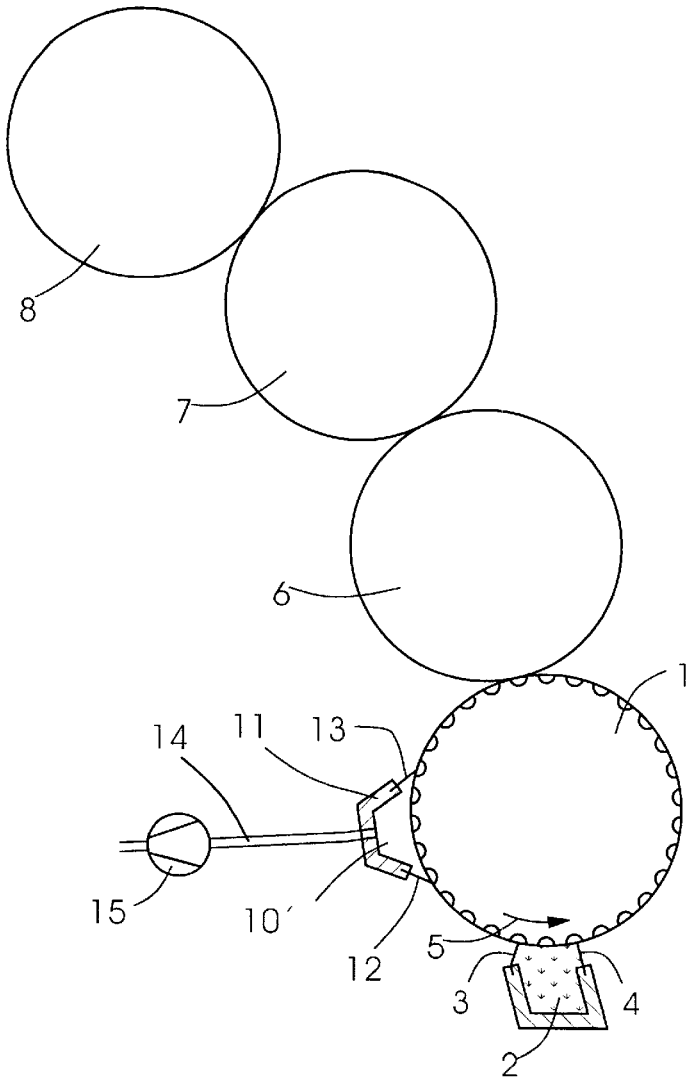
FIG. 1*b* is a fragmentary diagrammatic side elevation view of an alternate embodiment of the inking unit and a printing matching shown in FIG. 1*b* with the vacuum chamber located to act upon the dampening solution before it reaches the inking chamber.

In the construction illustrated in FIG. 1, the vacuum chamber 10 acts upon ink freshly conveyed out of the inking chamber 2. Because of the transport of dampening solution from the plate cylinder 7, via the rollers of the inking unit 6,1, into the inking chamber 2, this ink can be diluted undesirably. Alternatively, the vacuum chamber can also be arranged at the position 10' illustrated in [broken lines in] FIG. 1*b*. Thereat, it acts upon dampening solution in the ink emulsion conveyed back from the ink applicator roller 6 to the screen roller 1, before the emulsion reaches the inking chamber 2, and thus prevents dilution of the ink in the inking chamber 2. Of course, two or more vacuum chambers like the chambers 10 and 10' can also be provided on a roller or different rollers of the inking unit. It is also possible to arrange a vacuum chamber straddling a nip location between two rollers, so that the two closing doctor blades of the vacuum chamber slide on different rollers.

Figure 2:
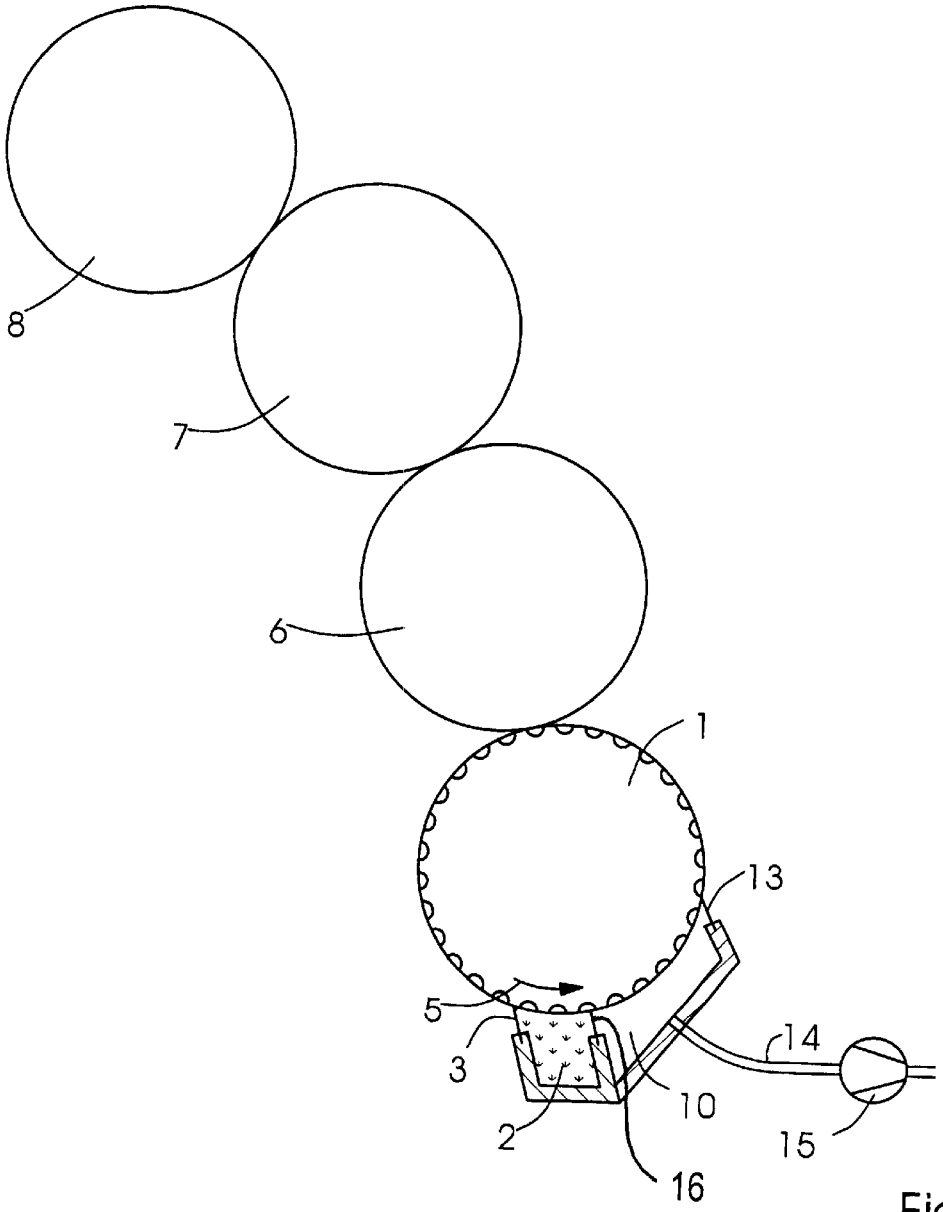
FIG. 2 is a view like that of FIG. 1 of a modified construction of the invention.

FIG. 2 shows a preferred further development of the embodiment of FIG. 1. In this configuration, the inking chamber 2 and the vacuum chamber 10 are arranged directly adjoining one another, and the closing doctor blades 4 and 12 of the configuration of FIG. 1 have been fused into a common working doctor blade 16, which delimits the inking chamber and the vacuum chamber directly from one another.

As shown in FIG. 2, the direction of rotation 5 of the screen roller 1 can be selected so that the doctor blade 16 acts upon ink freshly metered out of the chamber 2, however, a direction of rotation may be selected that is opposite to the direction of rotation 5.

Figure 3:
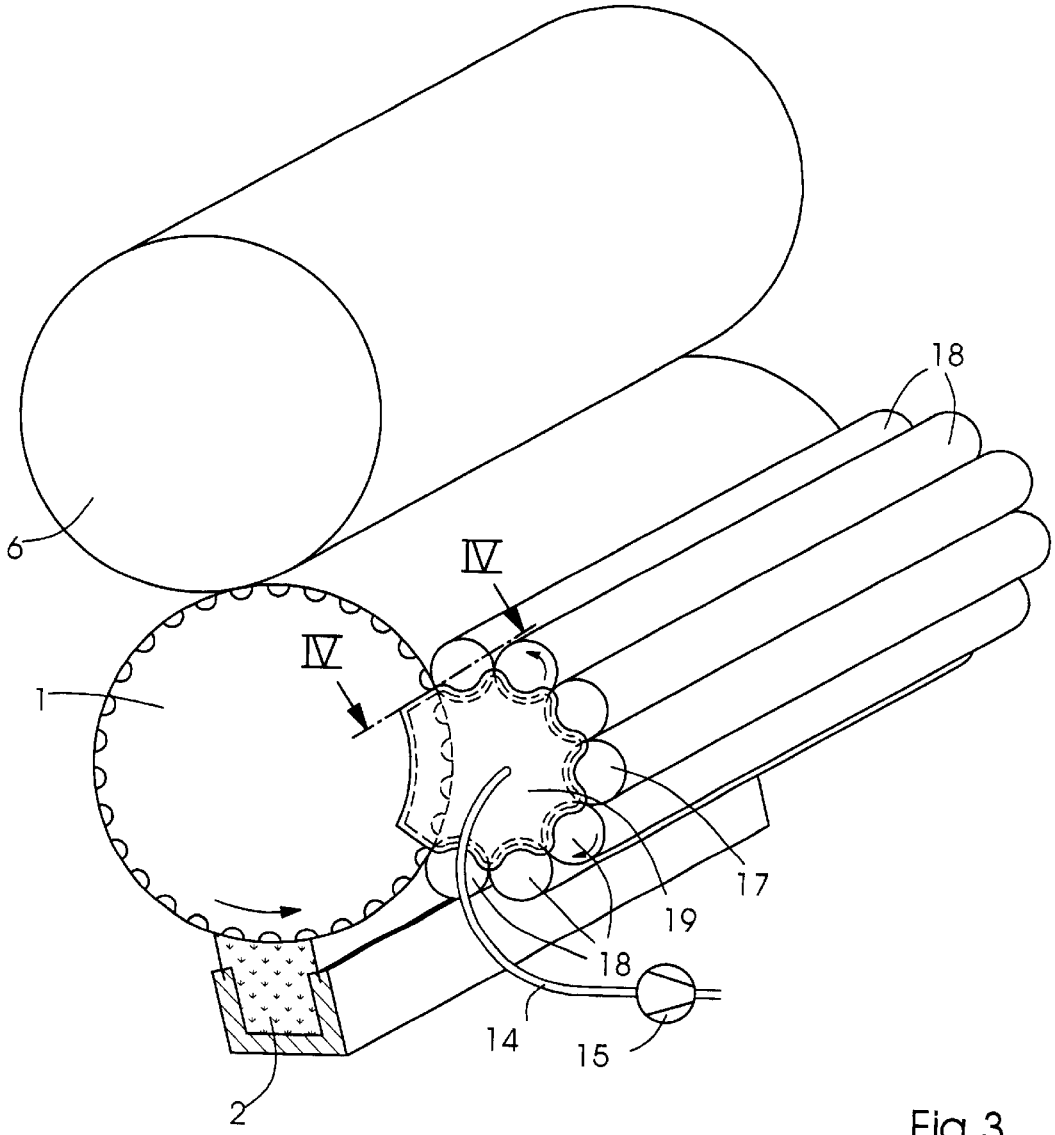
FIG. 3 is a perspective view of another embodiment of the inking unit.

FIG. 3 shows, in a perspective view, an inking unit according to a second embodiment of the invention. The inking unit includes an inking chamber 2, a screen roller 1 and an ink transfer roller 6, which correspond to those described hereinbefore with reference to FIG. 1. Seven narrow rollers 18 form a roller train which extends in a curved shape over a section of the screen roller 1. Each of the relatively narrow or slender rollers 18 either contacts two adjacent rollers 18 or one roller 18, along the peripheral surface thereof, as well as the surface of the screen roller 1. In this way, the train of the rollers 18 forms an airtight side wall of a vacuum chamber 17.

The rollers 18 are rotatably mounted in non-illustrated bearings. The number thereof is, in principle, arbitrary, but must be an odd number, so that the two rollers 18 which are in contact with the screen roller 1 rotate in the same direction.

The end faces of the vacuum chamber 17 are closed off by two plates 19, only one of which is visible in FIG. 3. A suction line 14 with a suction pump 15 is connected to the vacuum chamber 17 through the end plate 19.

Figure 4:
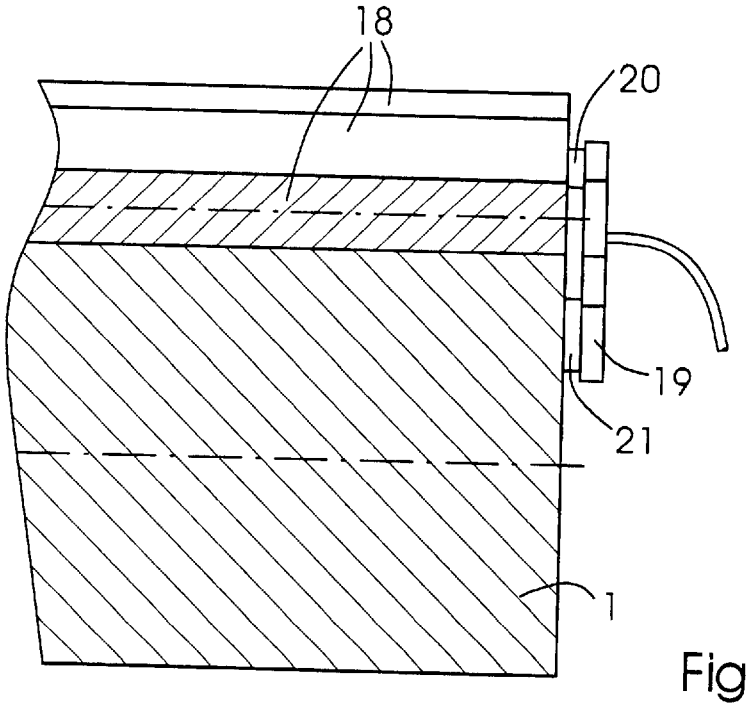
FIG. 4 is a fragmentary sectional view of FIG. 3 taken along the line IV—IV in the direction of the arrows.

FIG. 4 is a sectional view of FIG. 3 taken along the line IV—IV and the axis of rotation of the screen roller 1. A liquid sealing material 20 is deposited into a gap 21 between the plate 19 and the ends of the screen roller 1 and of the narrow rollers 18. The sealing material 20 is held in the gap 21, which is only a few tenths of a millimeter wide, by an electrostatic force, which is generated by applying a voltage to the electrically conductive roller bodies 1 and 18, on the one hand, and the plate 19, on the other hand. This type of seal is virtually wear-free and does not place any special requirements on the construction of the end faces of the rollers 1, 18.

Alternatively, the sealing material 20 that is used can also be a magnetic liquid that is kept in the gap by magnets. Such magnets can be embedded, for example, in the rollers 1 and 18 and/or preferably the plate 19.

Figure 5:
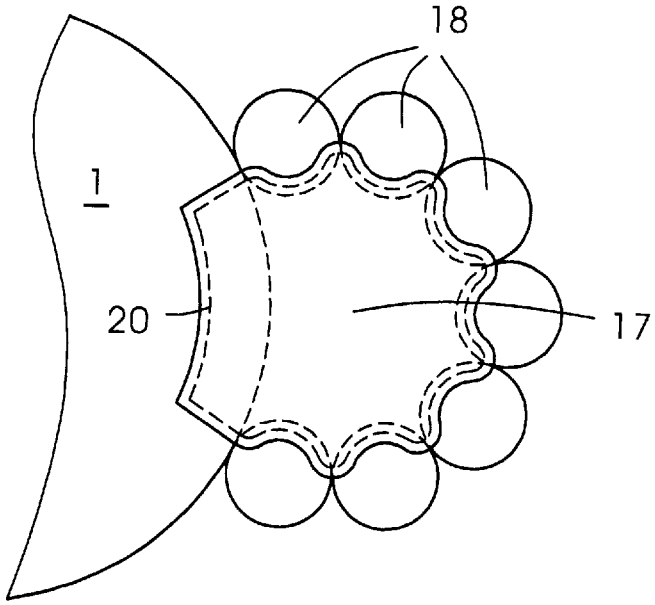
FIG. 5 is a view of FIG. 4 as seen from the righthand side thereof with the cover plate 19 removed.

FIG. 5 is a view from the righthand side of FIG. 4 with the cover plate 19 removed. As can clearly be seen, the sealing material 20 forms a closed ring which, respectively, in the vicinity of a nip location, merges without a gap from one of the narrow rollers 18 to another, or from one of the narrow end rollers to the screen roller 1.

Figure 6A:
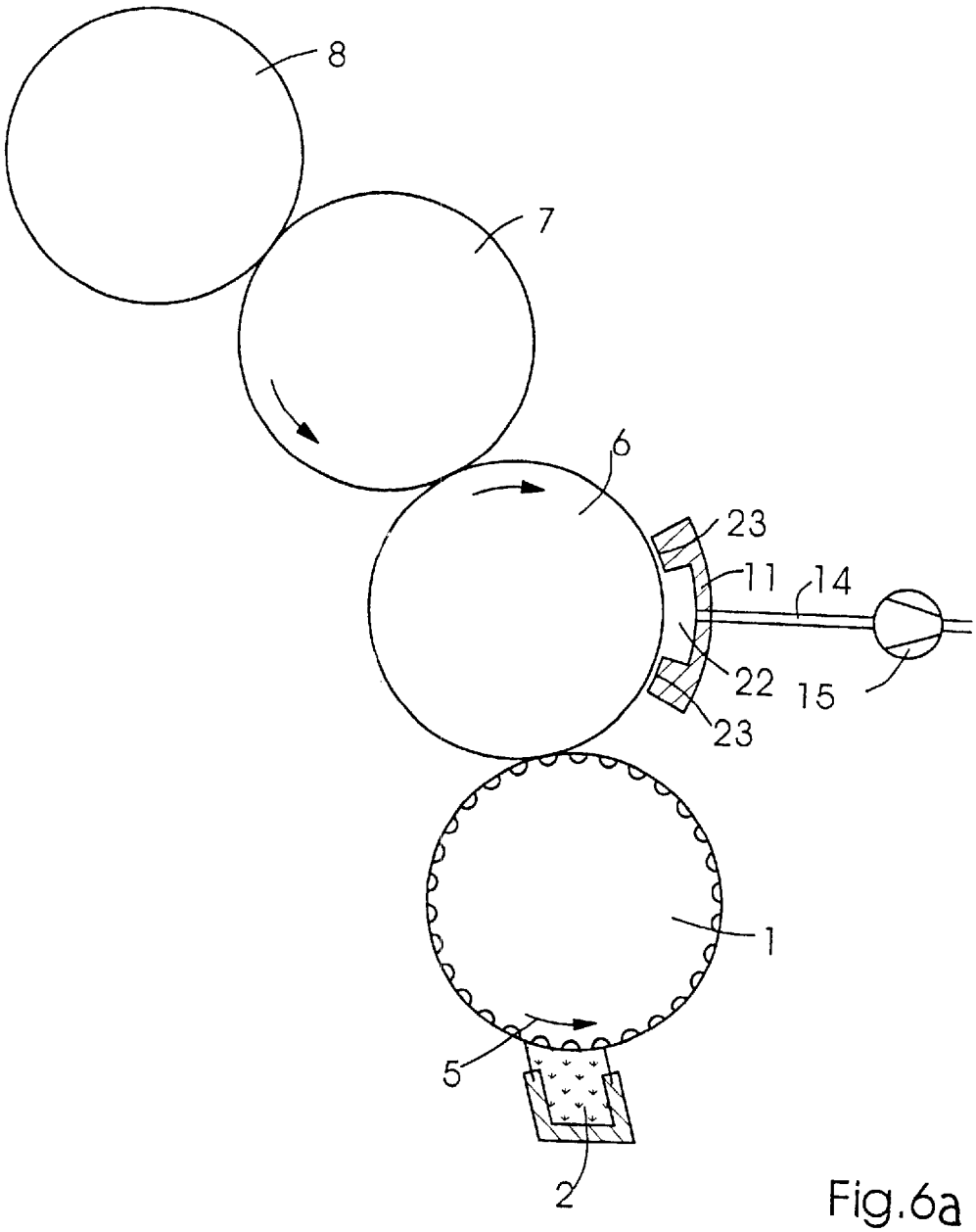
FIG. 6*a* is another view like that of FIG. 1 of a further embodiment of the inking unit.
Figure 6B:
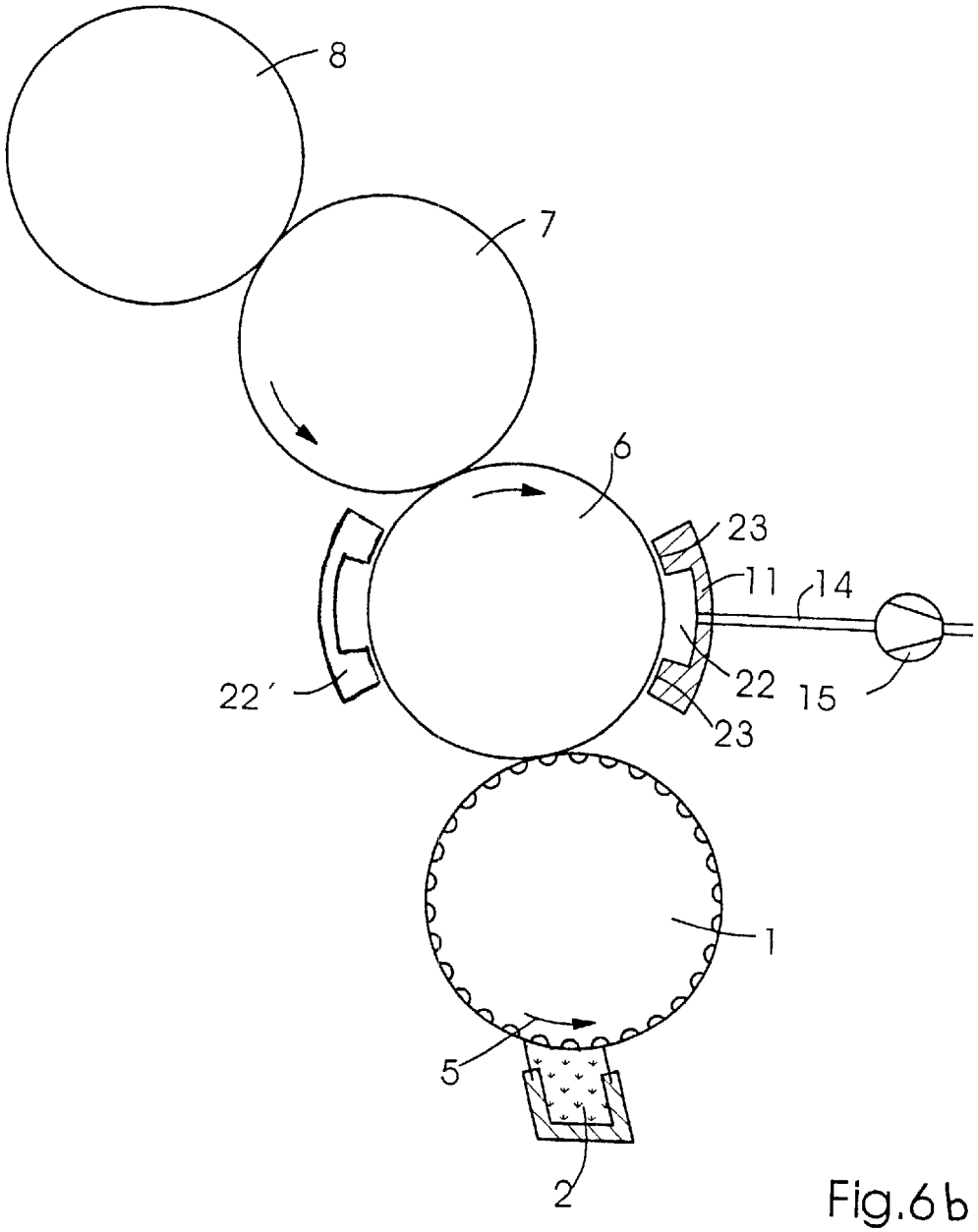
FIG. 6*b* is another view like that of FIG. 6*a* with a further vacuum chamber.

FIG. 6 is a diagrammatic side elevational view, partly in section, of a printing machine according to a third embodiment of the invention. The inking chamber 2, the screen roller 1, the ink applicator roller 6, the plate cylinder 7 and the blanket cylinder 8, respectively, correspond to those previously described herein with reference to FIG. 1. In the configuration of FIG. 6, the vacuum chamber 22 is arranged on the ink applicator roller 6. As described hereinabove with reference to FIG. 1, the vacuum chamber 22 has an elongated hood 11 extending over the axial length of the ink applicator roller 6, a suction line 14 and a suction pump 15 being connected thereto in order to generate a controlled vacuum. The peripheral length of the ink applicator roller 6 corresponds exactly to that of the plate cylinder 7. Therefore, during each revolution of the two rollers 6 and 7, identical points on the surfaces thereof make contact. Consequently, in the course of the printing operation, a pattern of the ink and dampening solution distribution is formed on the surface of the ink applicator roller, and corresponds to the printing image on the printing plate mounted on the plate cylinder 7. In order to print without any ghosting, this pattern must not be disrupted. The vacuum chamber 22 is therefore not sealed off with doctor blades sweeping over the surface of the ink applicator roller 6, but rather, with the aid of gap seals 23. These gap seals 23 form a bottleneck between the interior of the vacuum chamber 22 and the surrounding air which, for a height of fractions of a millimeter in the radial direction of the roller 6, can have a length in the peripheral direction of the roller in the range of centimeters. The dimensions of the gap seal 23 and the suction capacity of the pump 15 are dimensioned as a function of one another, in order to achieve a desired working vacuum in the chamber 22. Such non-contacting seals 23 may, in particular, be formed as labyrinth seals.

The vacuum chamber 22 is arranged on the ink applicator roller 6 in such a manner that it acts upon ink/dampening solution emulsion coming from the nip location between the plate cylinder 7 and the ink applicator roller 6. As an alternative or in addition thereto, a further vacuum chamber 22' can be arranged on the opposite side of the roller 6, for acting upon such an emulsion before it enters the nip location; see FIG. 6*b*.

Of course, the vacuum chamber 22 or 22' can also be combined with one or more of the vacuum chambers described with reference to the preceding figures.

Figure 7:
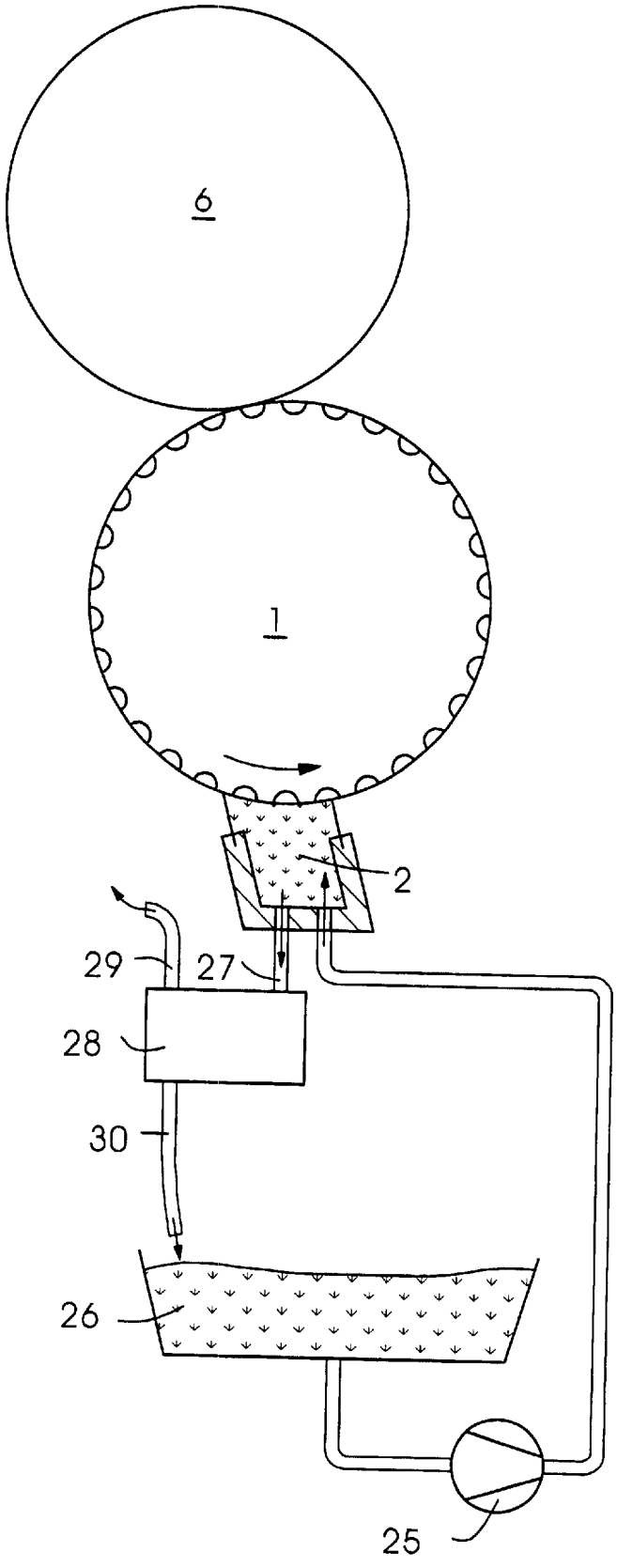
FIG. 7 is an enlarged fragmentary, diagrammatic and schematic side elevational view of yet another embodiment of the inking unit.

FIG. 7 shows a further configuration of the inking unit according to the invention. The rollers 1 and 6 and the inking chamber 2 correspond to those in the other embodiments or modifications described hereinbefore. Shown as a further component of the ink metering system is a pressure pump 25, which supplies the inking chamber 2 with printing ink from a storage container or ink fountain 26.

Ink emulsion conveyed back from the screen roller 1 into the inking chamber 2 and having a high share of dampening solution and being thinner than fresh emulsion delivered by the pressure pump 25, flows via a discharge line 27 into an evaporator unit 28, which includes a vacuum chamber and a vacuum pump. Dampening-solution vapor is expelled via an output line 29; ink with a reduced proportion of dampening solution flows via a line 30 from the evaporator unit 28 into the ink fountain 26. Valves can be provided between the vacuum chamber of the evaporator unit 28 and the lines 27 and 30, respectively, in order to isolate the vacuum chamber from the lines from time to time and to evacuate it, in order to dry a quantity of ink emulsion which has entered the chamber in a batch process. Using this arrangement, the share or portion of dampening solution of the ink fed back into the ink fountain 26 can be matched in a straightforward manner to a desired value or to the share of dampening solution in the ink contained in the ink fountain 26. In addition, in this configuration, it is readily possible to provide a heating device in the evaporator unit 28, in order to intensify the drying of the ink, without thereby having any effect on the temperature and moisture relationships at other locations in the printing machine.

According to further embodiments, the ink mixed with dampening solution can also be removed from any other desired roller in the inking unit with the aid of a separate doctor blade, collected in a container and fed to an evaporator unit like the unit 28 and dried in the latter. It is also possible to fuse the evaporator unit 28 and the ink fountain 26, i.e., to provide an air chamber under vacuum directly above the liquid level in the ink fountain 26, so that the evaporation can take place at the surface of the ink in the ink fountain. It would even be possible to provide a conveyor loop or circuit separated from the ink delivery path between the storage container and the plate cylinder, wherein ink is circulated between a storage container and an evaporator unit, in order to dry the ink in the evaporator unit.

Configurations wherein the evaporation of the ink does not take place directly on a roller but in a chamber separated from the rollers, such as the chamber of the evaporator unit 28, offer the advantage that the chamber can be constructed from the general viewpoint of an optimum evaporation capability, so that with a given evaporation capacity, the overall volume can be kept low, and so that such a chamber can be positioned largely freely from the point of view of expediency in relation to the rollers of the inking unit or of the entire printing machine, which simplifies the construction of the inking unit.

We claim:

1. An inking unit for a printing machine, having a metering system for printing ink, and equipment for conveying ink on a conveyor path between the metering system and a plate cylinder of a printing machine, comprising a vacuum chamber for evaporating a dampening-solution portion from the printing ink, said vacuum chamber being bounded on a longitudinal side thereof by at least one roller of the ink-conveying equipment and also by a hood-like cover extending along the roller and having longitudinal edges facing towards the roller, said longitudinal edges being sealed off by closing doctor blades.

2. The inking unit according to claim 1, wherein said conveyor path passes through said vacuum chamber.

3. The inking unit according to claim 1, wherein the ink-conveying equipment includes at least another roller forming with said one roller a chain of mutually contacting rollers, at least said longitudinal side of said vacuum chamber being formed by said train of mutually contacting rollers.

4. The inking unit according to claim 3, wherein said vacuum chamber has end faces closed by respective plates.

5. The inking unit according to claim 4, wherein a liquid or plastic sealing material is held between the rollers and said plates by at least one of electrostatic and magnetic interaction.

6. The inking unit according to claim 1, wherein the metering system includes a storage container, and wherein said vacuum chamber is connected directly to said storage container.

7. The inking unit according to claim 2, wherein said vacuum chamber is disposed in a line for feeding ink back into a storage container of the metering system.

8. The inking unit according to claim 2, wherein said vacuum chamber is disposed in a line for feeding ink from a storage container of the metering system to an inking chamber on a roller.

9. The inking unit according to claim 1, wherein said closing doctor blades are engaged with the roller so as to be pressed against the roller by air pressure prevailing in the surroundings of said pressure chamber.

10. An inking unit for a printing machine, having a metering system for printing ink, and equipment for conveying ink on a conveyor path between the metering system and a plate cylinder of a printing machine, comprising a vacuum chamber for evaporating a dampening-solution portion from the printing ink, said vacuum chamber being bounded on a longitudinal side thereof by at least one roller of the ink-conveying equipment, the roller being a screen roller, and the metering system including an inking chamber arranged on said screen roller.

11. The inking unit according to claim 10, wherein said vacuum chamber is also bounded by a hood-like cover extending along the roller and having longitudinal edges facing towards the roller.

12. The inking unit according to claim 11, wherein said longitudinal edges are sealed off by contact-free seals.

13. The inking unit according to claim 11, wherein said longitudinal edges are sealed off by closing doctor blades.

14. The inking unit according to claim 13, wherein said closing doctor blades are engaged with the roller so as to be pressed against the roller by air pressure prevailing in the surroundings of said pressure chamber.

15. The inking unit according to claim 10, wherein said vacuum chamber directly adjoins said inking chamber.

16. The inking unit according to claim 15, wherein said vacuum chamber and said inking chamber are separated from one another by a common doctor blade.

17. The inking unit according to claim 10, wherein said conveyor path passes through said vacuum chamber.

* * * * *